US008092893B2

(12) United States Patent
Duce

(10) Patent No.: US 8,092,893 B2
(45) Date of Patent: Jan. 10, 2012

(54) SAFETY PLACE MAT

(76) Inventor: Danielle Duce, Jacksonville, FL (US)

( * ) Notice: Subject to any disclaimer, the term of this patent is extended or adjusted under 35 U.S.C. 154(b) by 372 days.

(21) Appl. No.: 12/459,001

(22) Filed: Jun. 25, 2009

(65) Prior Publication Data

US 2010/0003448 A1 Jan. 7, 2010

Related U.S. Application Data

(60) Provisional application No. 61/076,619, filed on Jun. 28, 2008.

(51) Int. Cl.
*A47G 23/00* (2006.01)

(52) U.S. Cl. ..... 428/81; 428/119; 428/156

(58) Field of Classification Search ..... 428/81, 428/119, 156; 248/345.1, 346.01; 108/27, 108/26; 220/556
See application file for complete search history.

(56) References Cited

U.S. PATENT DOCUMENTS

| | | | | |
|---|---|---|---|---|
| 4,393,104 | A | | 7/1983 | Fink |
| 4,944,968 | A | | 7/1990 | Wagner |
| D353,275 | S | * | 12/1994 | Longhurst ..... D12/425 |
| 5,658,620 | A | | 8/1997 | Ross |
| 6,116,162 | A | | 9/2000 | Santa Cruz et al. |
| 6,783,831 | B2 | | 8/2004 | Cho |
| 7,032,772 | B2 | | 4/2006 | McCaslin |
| 7,182,993 | B1 | | 2/2007 | Hamilton |
| 2004/0043182 | A1 | | 3/2004 | Snedeker |
| 2004/0134598 | A1 | | 7/2004 | Ernst |
| 2005/0076814 | A1 | | 4/2005 | Madden |
| 2005/0120457 | A1 | | 6/2005 | Mesalic |
| 2007/0051864 | A1 | | 3/2007 | Bartell et al. |
| 2007/0207279 | A1 | | 9/2007 | Mesalic |
| 2007/0254134 | A1 | | 11/2007 | Han |

* cited by examiner

*Primary Examiner* — Alexander Thomas
(74) *Attorney, Agent, or Firm* — Rogers Towers, P.A.; Stephen E. Kelly

(57) ABSTRACT

A safety place mat designed to protect the user from injury due to inadvertent impact with the table or other rigid surface supporting the place mat. The place mat comprises a base panel upon which food and tableware may be placed. The base panel is surrounded by raised edges, which define a recessed base panel to contain spilled food and liquids. The proximal edge features an enhanced thickness for maximum protection against impact. A lip extends downwardly perpendicularly from the proximal edge to cushion the edge of the table. The proximal edge and lip can be curved to match the contour of a table or other support surface.

17 Claims, 4 Drawing Sheets

SAFETY PLACE MAT

This application claims the benefit of U.S. Provisional Patent Application Ser. No. 61/076,619, filed on Jun. 28, 2008.

BACKGROUND OF THE INVENTION

This invention relates generally to a place mat, and, more particularly, to a protective cushioned place mat designed to protect mainly the cranial region, face and upper body of a person while seated at a table or desk.

Head protection for various activities for children and adults is well known. Likewise, various cushions have been devised to provide protective coverings on furniture. For example, stretchable padded bands are known for providing a cushioned cover around table edges. Such devices are useful for protecting individuals that require protection from bodily injuries due to impact.

Numerous padded place mats are also known. For example, padded edge covers are known, as in U.S. Patent Publication No. 2005/0076814. Place mats that cover the exposed edge of a table are known, as in U.S. Patent Publication No. 2004/0043182, U.S. Patent Publication No. 2005/0076814, U.S. Patent Publication No. 2005/0120457, and U.S. Pat. No. 6,116,162. Place mats with recessed eating surfaces or eating surfaces surrounded by raised edges are also known U.S. Patent Publication No. 2007/0051864. U.S. Pat. No. 6,116,162 discloses a combination protective bumper and place mat comprising a plastic (e.g., vinyl) cover over padding. Slits are provided to receive rigid J-shaped inserts that give the place mat an edge-hugging shape. The place mat has a uniform thickness.

Each of these devices do provide some measure of protection for some area of the head. However, it is desirable to provide a place mat that includes a suitable amount of padding material to provide adequate protection around areas of a table or desk likely to be struck, fits snugly against a table edge, protects the entire upper region of the user's head, face and upper body, and is constructed of a cleanable material. The invention is directed to overcoming one or more of the problems and solving one or more of the needs as set forth above.

SUMMARY OF THE INVENTION

A safety place mat comprises a base panel upon which food and tableware may be placed, raised edges surrounding the base panel, an integral padded proximal edge, and an integral cushioning lip. The raised edges further comprise a distal edge, a left lateral edge, and a right lateral edge, which along with the proximal edge, define a recessed base panel that helps contain spilled food and liquids. The proximal edge features an enhanced thickness for maximum protection against impact. The lip extends downwardly perpendicularly from the proximal edge to cushion the user from the edge of the table. The proximal edge and lip can be curved to match the contour of any table or support surface.

DETAILED DESCRIPTION OF THE INVENTION

With reference to the drawings, the invention will now be described with regard for the best mode and the preferred embodiment. In general, the device is a place mat designed to protect the user from incidental or accidental impact with the object supporting the place mat. The following exemplary embodiments are in the context of a place mat for eating meals. However, the embodiments disclosed herein are meant for illustration and not limitation of the invention. An ordinary practitioner will understand that it is possible to use the device for other applications without undue experimentation.

Figure 4:
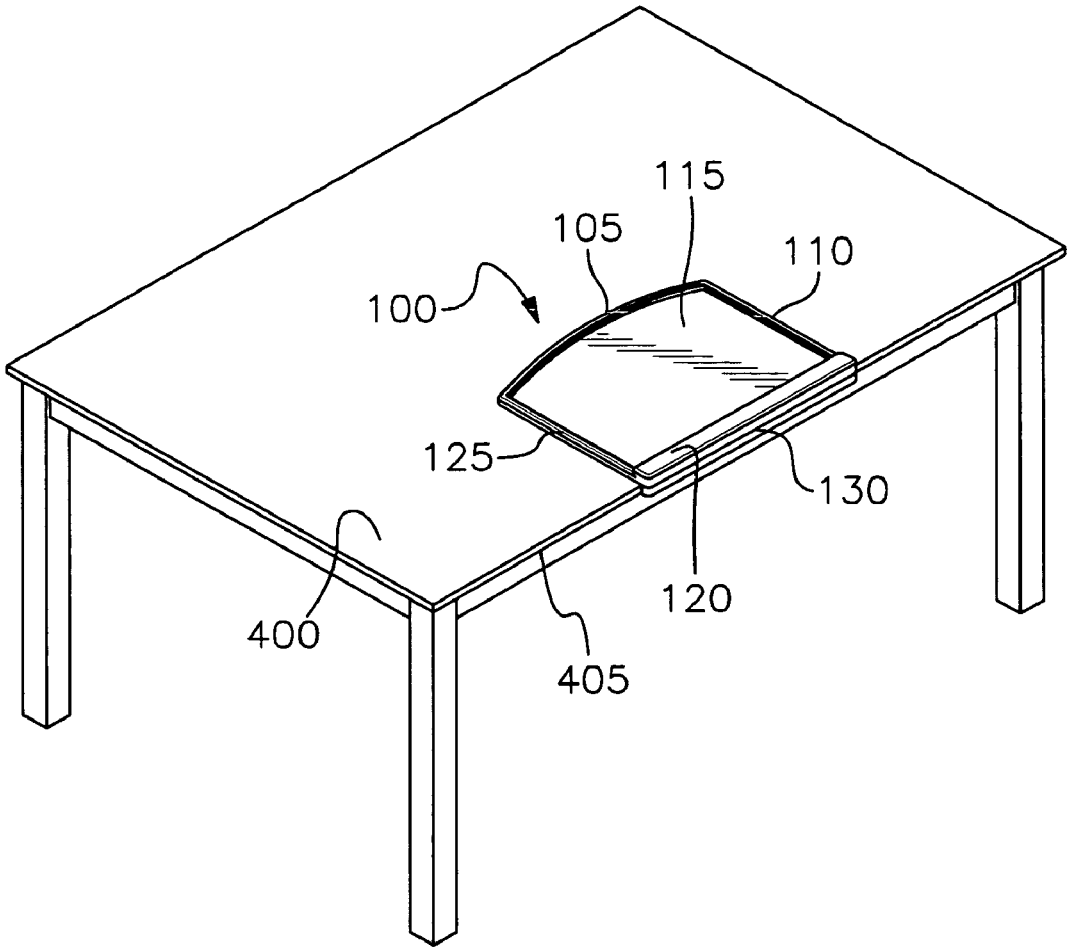
FIG. 4 is a perspective view of one embodiment of the place mat placed on a table.

Referring to the FIGS. 1-4, various views of an exemplary place mat according to principles of the invention are shown. The place mat 100 includes a base panel 115 upon which food and tableware may be placed. The base panel 115 is surrounded by raised edges 105, 110, 120 and 125. The proximal edge 120 is the edge closest to an edge 405 of a support surface 400, such as a table, when the place mat is installed as shown in FIG. 4. The distal edge 105 is opposite the proximal edge 120. Left and right lateral edges 125, 110 (as determined from the perspective of a user) connect the distal edge 105 and proximal edge 120. A lip 130 extends downwardly perpendicularly from the proximal edge 120. The recessed base panel 115 defines a reservoir to contain spills. The raised edges 105, 110, 120 and 125 help contain spilled food and liquids.

The safety place mat 100 is made from a resilient lightweight foam, preferably a closed cell foam of moderate density, most preferably ethylene vinyl acetate (EVA) foam having a density of from 0.05 to 1.0 g/cm$^3$. Although closed cell EVA foam is preferred, other open or closed cell foams may be used such as ENSOLITE®, United States Rubber Company's closed cell foam rubber made from a blend of polyvinyl chloride (PVC) and nitrile butadiene rubber (NBR); polyethylene, polyurethane and irradiated cross-linked polyethylene. The place mat 100 can be manufactured as a single, integral unit by injection molding.

To facilitate cleaning the safety place mat, the surface of the place mat 100 preferably is smooth and impermeable to liquids. This may be achieved by use of a self skinning (or integral skin) polyurethane, EVA, or other foam that develops a tough impermeable skin when molded. Alternatively, a skin may be bonded on the foam surface during or after the molding operation, by in-mold coating or dipping the finished foam pad into a coating such as liquid vinyl, or by bonding a flexible surface layer to the top of the safety place mat 100.

In one embodiment, the safety place mat 100 has a proximal edge 120 of increased thickness within the range of 0.25 to 2 inches, preferably about 0.75 inches thick to provide maximum cushioning at the most likely point of impact. The distal edge 105, right lateral edge 110 and left lateral edge 125 each have a thickness within the range of 0.25 to 2 inches. In one embodiment, the distal edge 105, right lateral edge 110 and left lateral edge 125 all have the same thickness, which is less than the thickness of the proximal edge 120. The base panel 115 has a thickness of about 0.3 to 0.75 times the thickness of the distal edge 105, right lateral edge 110 and left lateral edge 125. Preferably, the base panel 115 is at least 0.25 inches thick, which provides protection to the user from inadvertent impact with the table or other support surface 400. The lip 130 extends downwardly approximately 0.5 to 2 inches from the base and has a thickness that is about the same as the thickness of the proximal edge 120.

The safety place mat provides protection from head, face and upper body injury caused by sudden impacts to the top or the edge of tables, desks, countertops or other support surfaces 400. The additional thickness of the proximal edge 120 provides maximum protection where dangerous impacts most often occur. The safety place mat 100 is not limited to a particular size or shape. Instead, it may be customized to fit the contour, shape, size or style of any table, desk, countertop, or the like.

Figure 1:
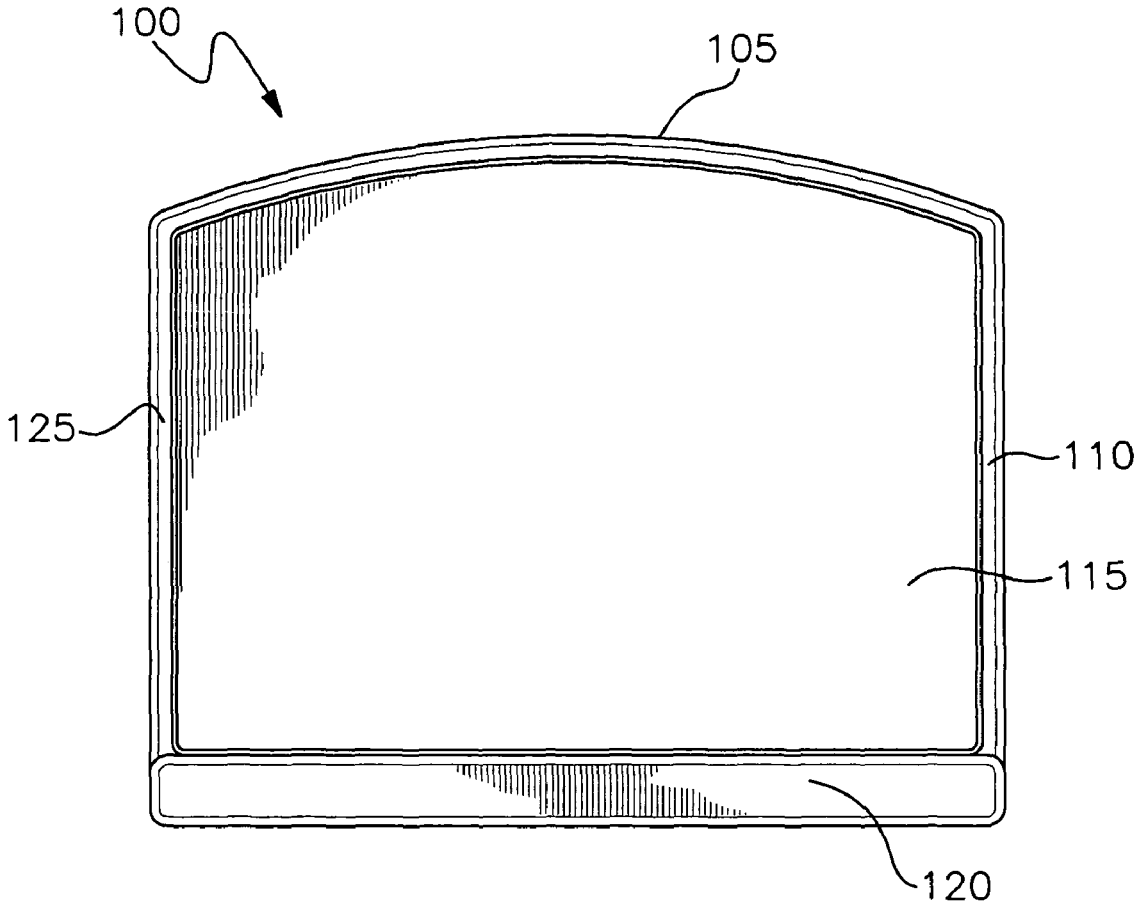
FIG. 1 is a top plan view of one embodiment of the place mat.
Figure 2:
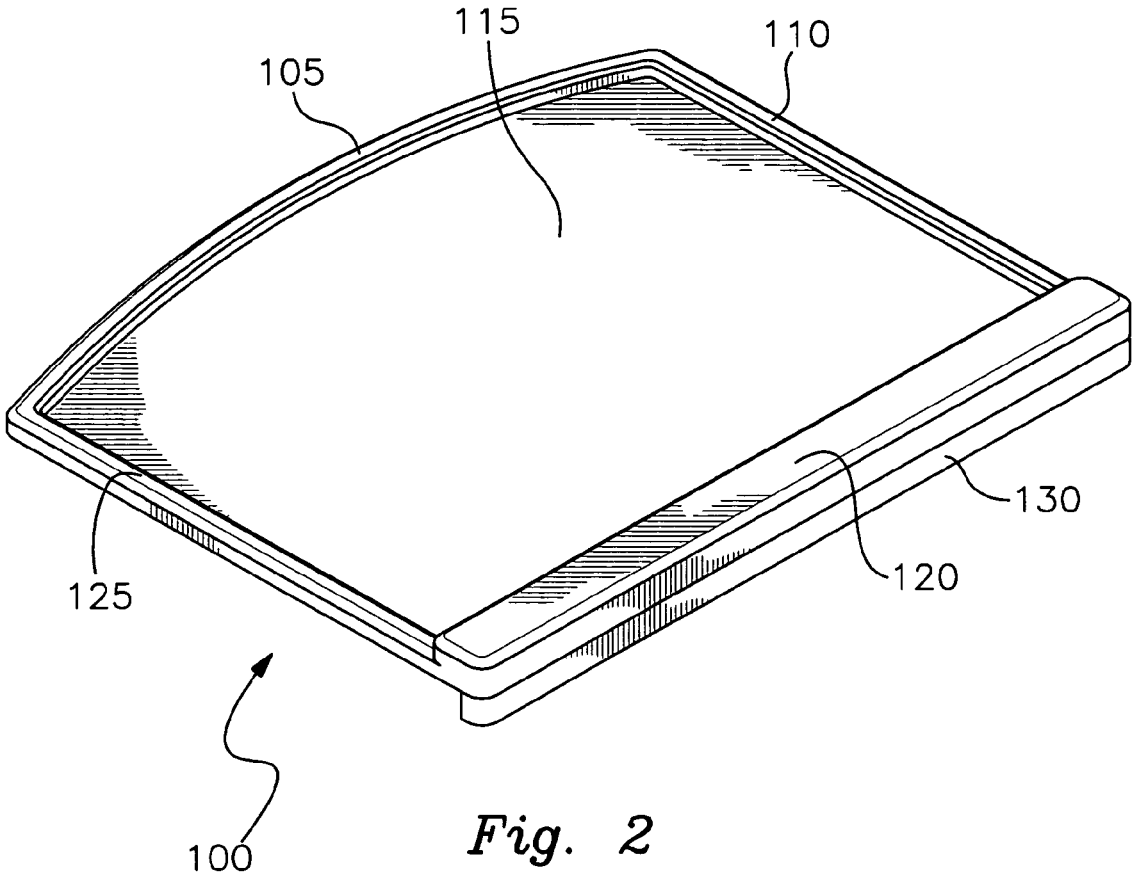
FIG. 2 is a perspective view of one embodiment of the place mat.
Figure 3:
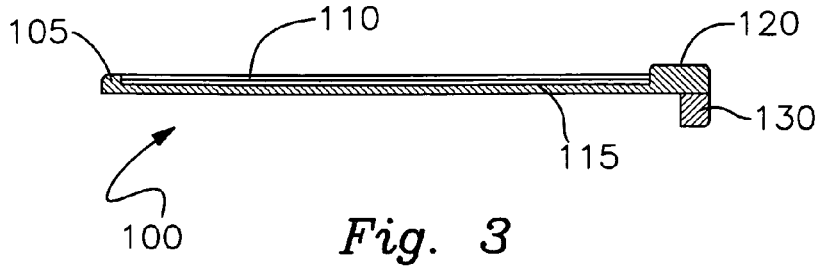
FIG. 3 is a side section view of one embodiment of the place mat.
Figure 5:
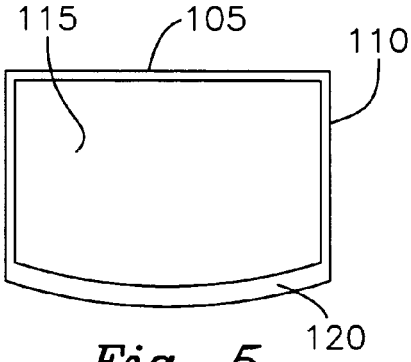
FIG. 5 is a top view of one embodiment of the place mat showing the proximal edge curved to accommodate the contoured edge of a support surface.
Figure 6:
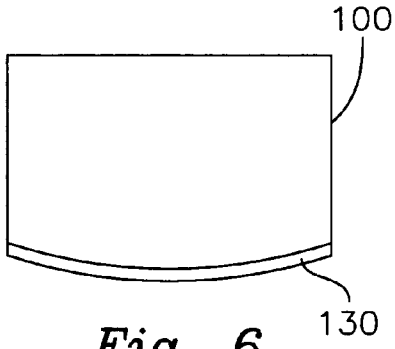
FIG. 6 is a bottom view of one embodiment of the place mat showing the lip curved to accommodate the contoured edge of a support surface.

For example, in one embodiment, shown in FIGS. 5 and 6, the proximal edge 120 can be curved to match the contour of a round table top or other contoured support surface 400. In this embodiment, the thickness of the proximal edge 120 remains constant along the length of the curve, and the base panel 115 must be adapted to integrally connect with the curved proximal edge. The lip 130 is also curved so that the lip 130 and proximal edge 120 maintain a substantially perpendicular intersection angle along the length of the curved edge. The lip 130 maintains a constant thickness along the length of the curve.

Figure 7:
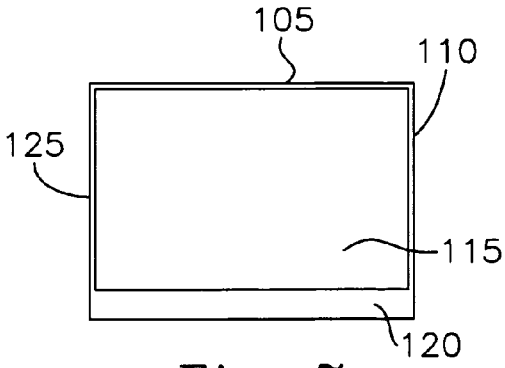
FIG. 7 is a tip view of one embodiment of the place mat.
Figure 8:
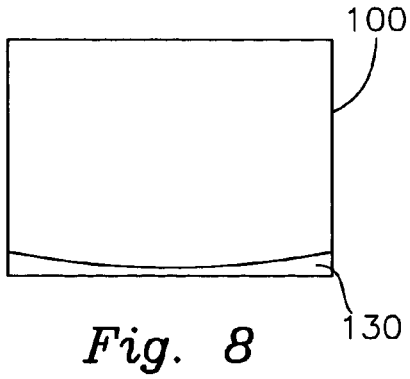
FIG. 8 is a bottom view of one embodiment of the place mat showing the lip having a varying thickness to accommodate the contoured edge of a support surface.

In another embodiment, shown in FIGS. 7 and 8, the thickness of the lip 130 can be varied to accommodate the curvature or contour of the support surface 400. In all embodiments, the minimum thickness of the lip 130 remains sufficient to cushion the user against inadvertent impact with the edge of the support surface 400, as described above. In this embodiment, the proximal edge 120 is substantially straight and maintains a constant thickness along its length, and the proximal edge 120 and lip 130 maintain a substantially perpendicular intersection angle. This embodiment may be preferable for ease of manufacture, storage, or use of the safety place mat 100.

Users of the safety place mat are infants, children, elderly people and other individuals who may be prone to seizures or other health related challenges that make them susceptible to impact with a table or similar structure. However, the invention is not limited to a particular user.

The safety place mat 100 is not limited to use with a table or desk. Instead, the safety place mat 100 may be utilized with any object having a planar surface and an edge that poses a risk of injury from impact. Such other objects may include, by way of example and not limitation, tray tables, such as hospital bedside tray tables, wheelchair tables, and the like.

The embodiments disclosed above are merely representative of the apparatus and process and not meant for limitation of the invention. For example, one having ordinary skill in the art would understand that the individual features of several disclosed embodiments are interchangeable with the features of other embodiments. Consequently, it is understood that equivalents and substitutions for certain elements and components set forth above are part of the invention, and therefore the true scope and definition of the invention is to be as set forth in the following claims.

I claim:

1. A safety place mat comprising:

a base panel surrounded by raised edges defining a reservoir, said raised edges comprising a proximal edge, a distal edge opposite the proximal edge, a left lateral edge, and a right lateral edge, said left lateral edge and right lateral edge connected to the distal edge and proximal edge, and said proximal edge having a depth thicker than said distal edge, left lateral edge, and right lateral edge; and a lip extending downwardly substantially perpendicular to the proximal edge, said lip having a thickness substantially similar to that of the proximal edge, wherein the base panel, distal edge, left lateral edge, right lateral edge, proximal edge, and lip are constructed of a foam material.

2. The safety place mat of claim 1 wherein the base panel, distal edge, right lateral edge, left lateral edge, proximal edge and lip are injection molded as a single, integral unit.

3. The safety place mat of claim 2 wherein the foam material comprises a surface coating such that the safety place mat is impervious to liquids.

4. The safety place mat of claim 3 wherein the thickness of the base panel is in the range of 0.125 to 0.5 inches.

5. The safety place mat of claim 4 wherein the thickness of the distal edge, left lateral edge, and right lateral edge is in the range of 0.25 to 2.0 inches.

6. The safety place mat of claim 5 wherein the thickness of the proximal edge is in the range of 0.5 to 2.0 inches.

7. The safety place mat of claim 6 wherein the lip depends from the base panel a distance in the range of 0.5 to 2.0 inches.

8. The safety place mat of claim 7 wherein the foam has a density in the range of 0.05 to 1.0 $g/cm^3$.

9. The safety place mat of claim 3 wherein the thickness of the proximal edge is at least three times the thickness of the base panel.

10. The safety place mat of claim 9 wherein the thickness of the distal edge, left lateral edge, and right lateral edge is at least twice the thickness of the base panel.

11. The safety place mat of claim 10 wherein the foam has a density in the range of 0.05 to 1.0 $g/cm^3$.

12. The safety place mat of claim 3 wherein the proximal edge and lip are curved to accommodate the contoured shape of a support surface.

13. The safety place mat of claim 12 wherein the thickness of the proximal edge is at least three times the thickness of the base panel.

14. The safety place mat of claim 13 wherein the thickness of the distal edge, left lateral edge, and right lateral edge is at least twice the thickness of the base panel.

15. The safety place mat of claim 3 wherein the lip comprises a varying thickness such that the contour of the lip accommodates the shape of a support surface.

16. The safety place mat of claim 15 wherein the thickness of the proximal edge is at least three times the thickness of the base panel.

17. The safety place mat of claim 16 wherein the thickness of the distal edge, left lateral edge, and right lateral edge is at least twice the thickness of the base panel.

* * * * *